United States Patent [19]

Maxwell et al.

[11] Patent Number: 4,790,579

[45] Date of Patent: Dec. 13, 1988

[54] SLIDING SPRING LATCH

[75] Inventors: James Maxwell, Clarkston; Rodney Raabe, Tucker, both of Ga.

[73] Assignee: Siemens Energy & Automation, Inc., Atlanta, Ga.

[21] Appl. No.: 161,557

[22] Filed: Mar. 1, 1988

[51] Int. Cl.[4] ..... E05C 1/10

[52] U.S. Cl. ..... 292/175; 292/DIG. 61; 292/337; 292/DIG. 38

[58] Field of Search ..... 292/175, 163, DIG. 38, 292/DIG. 73, DIG. 31, 171, DIG. 57, DIG. 61, 337

[56] References Cited

U.S. PATENT DOCUMENTS

| | | | |
|---|---|---|---|
| 477,537 | 6/1892 | Gutermute | 292/175 |
| 756,924 | 4/1904 | Wood . | |
| 942,716 | 12/1909 | Deskins . | |
| 1,549,470 | 8/1925 | Egbert . | |
| 3,038,747 | 6/1962 | Rapata | 292/DIG. 38 X |
| 3,309,126 | 3/1967 | Schnette | 292/175 |
| 3,632,007 | 1/1972 | Kantor | 292/175 X |
| 3,850,464 | 11/1974 | Bisbing et al. | 292/175 |
| 4,337,972 | 7/1982 | Gill | 292/67 |
| 4,471,980 | 9/1984 | Hickman | 292/19 |

FOREIGN PATENT DOCUMENTS

| | | | |
|---|---|---|---|
| 369040 | 6/1963 | Switzerland | 292/DIG. 38 |

*Primary Examiner*—Richard E. Moore

*Attorney, Agent, or Firm*—James G. Morrow

[57] ABSTRACT

A two-piece spring latch assembly operable as a closure device for a load center cabinet, wherein the latch assembly is slidably engagable with the door of a load center cabinet. The latch assembly includes a sliding latch body having a top surface with a depression for facilitating engagement of the latch body. The latch body also includes a latch member for engaging the frame of the load center cabinet. A latch spring is mounted to the latch member and defines a spring member for urging the sliding latch body into a latched position. The latch spring also defines a latch bearing surface and a strike bearing surface. These surfaces are fabricated from the same material as the spring member and resist wear through repeated cycles of engagement and disengagement with the frame of the load center cabinet.

4 Claims, 2 Drawing Sheets

SLIDING SPRING LATCH

BACKGROUND OF THE INVENTION

This invention relates to a cabinet closure, and more particularly, to a two-piece sliding spring latch assembly.

Typically, the closures for electrical cabinets enclosing load centers have been friction fit metal latches. One problem with these latches is that they do not provide for a positive engagement closure and, accordingly, can not be relied upon to keep a load center door closed during a high fault short circuit. Another problem with many cabinet latches is that they can cause a cabinet door to bind when an attempt is made to open the door. Many latches also cause a cabinet door to bounce open if the cabinet door is not pressed completely shut or a very high force is not used to slam the cabinet door closed.

Accordingly, it is the object of the present invention to provide a latch assembly which can be produced cost effectively while solving some or all of the above-mentioned problems.

SUMMARY OF THE INVENTION

The present invention provides for a two-piece spring latch assembly comprising a sliding latch body defining a top surface and a bottom surface, the top surface defining means for engaging the sliding latch body; a latch member extending from the bottom surface defining a latch surface and a strike surface; and a latch spring defining a spring member, a latch bearing surface and a strike bearing surface. The spring member is adapted for urging the sliding latch body into a latched position, while the latch bearing surface is fixed upon the latch surface and the strike bearing surface is fixed upon the strike surface.

BRIEF DESCRIPTION OF THE DRAWINGS

The invention may be more readily understood by reference to the preferred embodiment of the invention shown in the accompanying drawings in which.

DESCRIPTION OF THE PREFERRED EMBODIMENT

Figure 1:
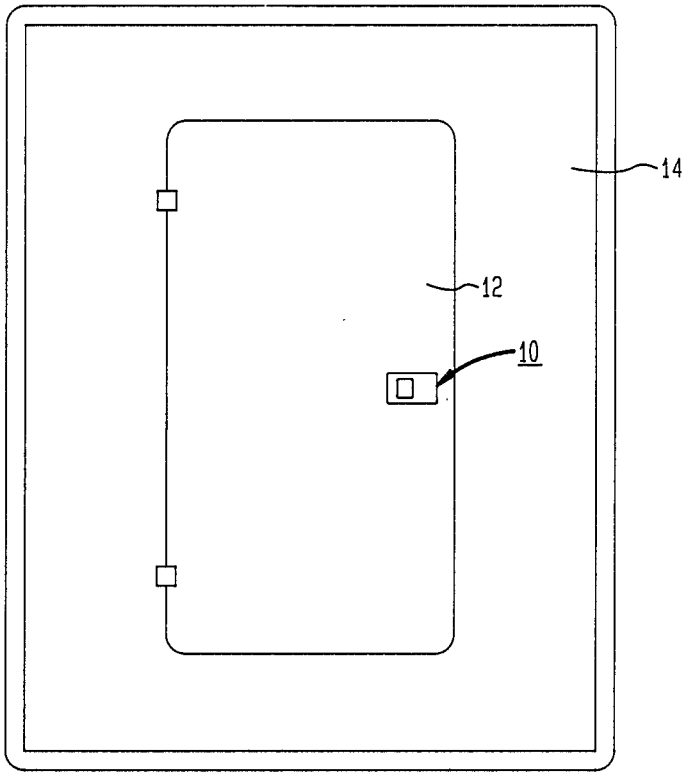
FIG. 1 illustrates the front side of an electrical cabinet and door.
Figure 2:
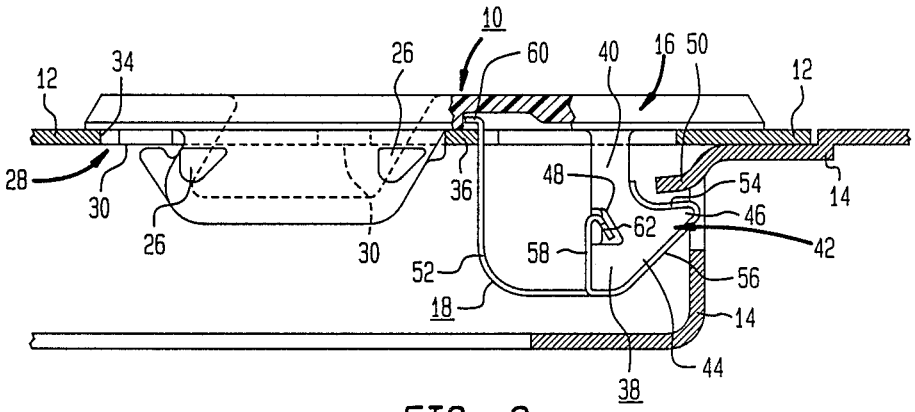
FIG. 2 is a partial cross-sectional view of the sliding spring latch in its latched position.
Figure 7:
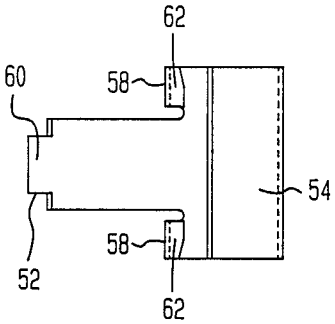
FIG. 7 is a top view of the latch spring.
Figure 3:
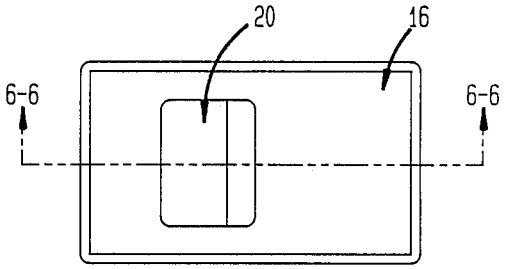
FIG. 3 is a top view of the latch body.
Figure 8:
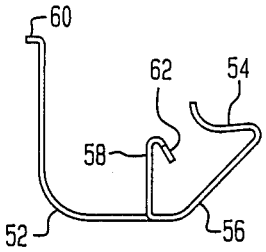
FIG. 8 is a side view of the latch spring.
Figure 4:
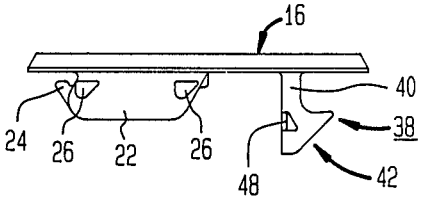
FIG. 4 is a side view of the latch body.
Figure 6:
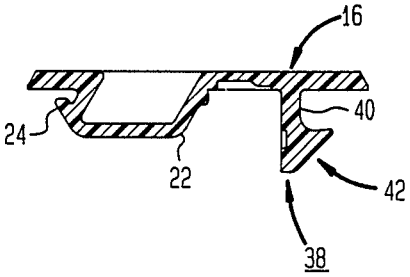
FIG. 6 is a sectional view taken along line 6—6.
Figure 5:
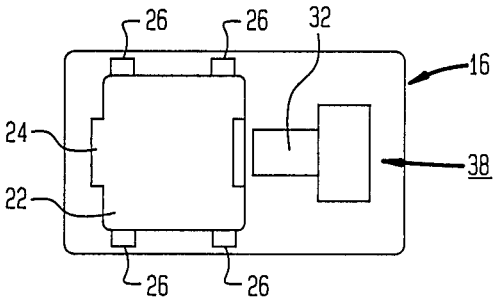
FIG. 5 is a bottom view of the latch body.

FIG. 1 illustrates the relationship of the sliding spring latch 10 to an electrical cabinet 14 and the electrical cabinet door 12. FIG. 2 is a side view of the sliding spring latch 10 in its latched position illustrating the components of the spring latch 10. The two main components of the spring latch are the sliding latch body 16 and the latch spring 18.

The latch body 16 is further illustrated in FIGS. 3–6. In the preferred embodiment of the spring latch 10 a depression 20 in the latch body 16 serves as a means for engaging the latch body 16 for purposes of moving the spring latch 10 from its latched position. The exterior of the wall 22 of the depression 20 includes a retainer member 24 and four (4) door engagement members 26.

To insert the spring latch 10 into the spring latch channel 28 of the cabinet door 12, the door engagement members 26 are aligned with insertion slots 30 before the spring latch 10 is snapped into the door 12. The door engagement members 26 function to maintain the latch 10 in sliding engagement with the door 12 when the members 26 are not aligned with the slots 30. To maintain the latch 10 in engagement with the door 12 when the members 26 are aligned with the slots 30, the retainer member 24 engages the door at the end 34 of the slot 30 while the spring 18 engages the spring stop 36.

The latch member 38 extends from the bottom surface of the latch body 16 and includes a support 40 for an end section 42 having a substantially triangular cross-section. The end section 42 includes a strike surface 44, a latch surface 46 and two spring engagement recesses 48.

The latch spring 18 is a one piece unit fabricated from a single piece of material. The latch spring 18 includes a spring member 52, a strike bearing surface 56, a latch bearing surface 54 and two engagement members 58. The latch spring 18 is shaped so that it slides over the end section 42 of the latch member 38. When combined with the latch member 38, the spring latch 10 is provided with a spring member 52, a wear resistant strike bearing surface 54 supported by the strike surface 44 and a wear resistant latch bearing surface 56 supported by the latch surface 46. From FIG. 2 it can be appreciated that without the surfaces 54, 56, the surfaces 44, 46 of the plastic end section 42 would be exposed to wear caused by their interaction with the cabinet catch 50 during the opening and closing of the door 12.

The spring member 52 extends from the strike bearing surface 56 down to the spring channel 32, wherein the hook portion 60 is guided by the spring channel 32. The hook portion 60 also serves to prevent the end of the spring member 52 from slipping off of the spring stop 36. The engagement members 58, along with the configuration of the latch spring 18, fixes the latch spring 18 to the latch member 38. The engagement members 58 engage the latch member 38 by means of two prongs 62 extending into the spring engagement recesses 48. The prongs 62 and recesses 48 cooperate to prevent the latch spring 18 from pulling off of the latch member 38 or sliding along the latch member 38.

By way of example, and with no limitations intended, the latch body can be fabricated from a nylon such as Du Pont Zytel® 101L or Monsanto Vydyne® X21 and the latch spring can be fabricated from spring steel.

Where, in one embodiment of the invention various modifications have been shown and described, various other modifications intended to be included within the scope of this invention will become apparent from the preceding description to one skilled in the art.

I claim:

1. A two-piece spring latch assembly comprising:

a sliding latch body defining a top surface and a bottom surface, the top surface defining means for engaging the sliding latch body;

a latch member extending from the bottom surface defining a latch surface and a strike surface;

a latch spring defining a spring member, a latch bearing surface and a strike bearing surface;

the spring member being adapted for urging the sliding latch body into a latched position, the latch bearing surface being fixed relative to the latch surface and the strike bearing surface being fixed relative to the strike surface.

2. The apparatus of claim 1, wherein the latch member further defines a support, a substantially triangular shaped end section and a spring engagement recess; the latch surface and strike surface being located upon the end section.

3. The apparatus of claim 2, wherein the latch spring further defines an engagement member for fixing the latch bearing surface and the strike bearing surface relative to the end section.

4. The apparatus of claim 3, wherein the sliding latch body further defines at least one door engagement member for maintaining the spring latch assembly in sliding engagement with a door.

* * * * *